US011033962B2

(12) United States Patent
Persaud et al.

(10) Patent No.: US 11,033,962 B2
(45) Date of Patent: Jun. 15, 2021

(54) NUCLEARIZED HOT ISOSTATIC PRESS

(71) Applicants: Rajendra Persaud, Westerville, OH (US); Jeff Moller, Columbus, OH (US); Dan Taylor, Fairview, PA (US); Paul Guey, Columbus, OH (US); Clifford Orcutt, Ashville, OH (US)

(72) Inventors: Rajendra Persaud, Westerville, OH (US); Jeff Moller, Columbus, OH (US); Dan Taylor, Fairview, PA (US); Paul Guey, Columbus, OH (US); Clifford Orcutt, Ashville, OH (US)

(73) Assignee: AMERICAN ISOSTATIC PRESSES, INC., Columbus, OH (US)

( * ) Notice: Subject to any disclaimer, the term of this patent is extended or adjusted under 35 U.S.C. 154(b) by 809 days.

(21) Appl. No.: 15/644,441

(22) Filed: Jul. 7, 2017

(65) Prior Publication Data

US 2018/0009034 A1 Jan. 11, 2018

Related U.S. Application Data

(60) Provisional application No. 62/539,766, filed on Jul. 8, 2016.

(51) Int. Cl.

| | |
|---|---|
| ***B22F 3/02*** | (2006.01) |
| ***B22F 3/15*** | (2006.01) |
| ***G21F 9/36*** | (2006.01) |
| ***B30B 15/32*** | (2006.01) |
| ***B30B 11/00*** | (2006.01) |
| ***G21F 9/30*** | (2006.01) |

(52) U.S. Cl.
CPC ..... *B22F 3/15* (2013.01); *B30B 11/002* (2013.01); *B30B 15/32* (2013.01); *G21F 9/30* (2013.01); *G21F 9/36* (2013.01); *B22F 2003/153* (2013.01)

(58) Field of Classification Search
CPC ..... B22F 3/15; B22F 2003/153; B29C 43/10
See application file for complete search history.

(56) References Cited

U.S. PATENT DOCUMENTS

| | | | | |
|---|---|---|---|---|
| 4,720,256 | A * | 1/1988 | Asari | B22F 3/03 425/405.2 |
| 4,983,112 | A * | 1/1991 | Uehara | B22F 3/15 425/78 |
| 2007/0228596 | A1* | 10/2007 | Fujikawa | B30B 11/002 425/405.2 |
| 2015/0314547 | A1* | 11/2015 | Grobl | B30B 15/007 425/78 |

* cited by examiner

*Primary Examiner* — Thu Khanh T Nguyen
(74) *Attorney, Agent, or Firm* — Finnegan, Henderson, Farabow, Garrett & Dunner, LLP

(57) ABSTRACT

There is disclosed a nuclearized hot-isostatic press (HIP) system comprising, a high temperature HIP furnace and a multi-wall vessel surrounding the furnace, such as a dual walled vessel comprising concentric vessels. The described multi-walled vessel comprises at least one detector contained between the walls to detect a gas leak, a crack in a vessel wall, or both. The disclosed HIP system also comprises multiple heads located on top and underneath the furnace, a yoke frame, and a lift for loading and unloading a HIP can to the high temperature HIP furnace. There is also disclosed a method of using such a system to provide ease of maintenance, operation, decontamination and decommissioning.

19 Claims, 3 Drawing Sheets

NUCLEARIZED HOT ISOSTATIC PRESS

This application claims priority to U.S. Provisional Application No. 62/359,766, filed on Jul. 8, 2016, which is incorporated herein by reference in its entirety.

There is disclosed a Hot Isostatic Press ("HIP") system that is able to process radioactive materials, either manually or remotely. There is also disclosed a method of using such a HIP system to provide ease of maintenance, operation, decontamination and decommissioning.

Hot Isostatic Pressing is a mature technology that is used to process many tons of material every day including castings and components made from powder metallurgy. These systems typically operate in an industrial setting and rely on the ability for direct operator intervention for almost every step. For example, hands-on processing is required for loading and unloading of the HIP system, maintenance of the supporting infrastructure, inspection, and if necessary, changing of critical seals at the location of the HIP vessel. In addition, regular interval inspection of the vessel to mitigate issues with potential gas leaks or vessel failures is critical.

In addition, if the HIP system is operating in a radioactive environment the operators must be shielded from radiation. Thus, depending on the level of radiation or activity, remote location and/or remote operation of the HIP system may be necessary. Therefore, the ability for an operator to have hands on intervention is either not practically possible or must be done at considerable risks.

In order to address and eliminate the foregoing problems, there is disclosed a nuclearized HIP system that not only considers the issues of safety, operating and maintaining a HIP in a radioactive environment, but also mitigates a majority of those problems. The disclosed nuclearized HIP system is directed to overcoming one or more of the problems set forth above and/or other problems of the prior art.

SUMMARY

In one aspect, the present disclosure is directed to a nuclearized hot-isostatic press (HIP) system comprising, a high temperature HIP furnace; a multi-wall vessel surrounding the furnace, wherein the multi-walled vessel comprises at least one detector contained between the walls to detect a gas leak, a crack in a vessel wall, or both; multiple heads located on top and underneath the furnace; a yoke frame; and a lift for loading and unloading a HIP can to the high temperature HIP furnace. In one embodiment, the at least one detector comprises a pressure detector, a gas flow detector, a chemical detector, a radiation detector, or an acoustic detector.

There is also disclosed a method of using such a system to provide ease of maintenance, operation, decontamination and decommissioning.

It is to be understood that both the foregoing general description and the following detailed description are exemplary and explanatory only and are not restrictive of the invention, as claimed.

DETAILED DESCRIPTION OF THE DRAWINGS

Figure 1A:
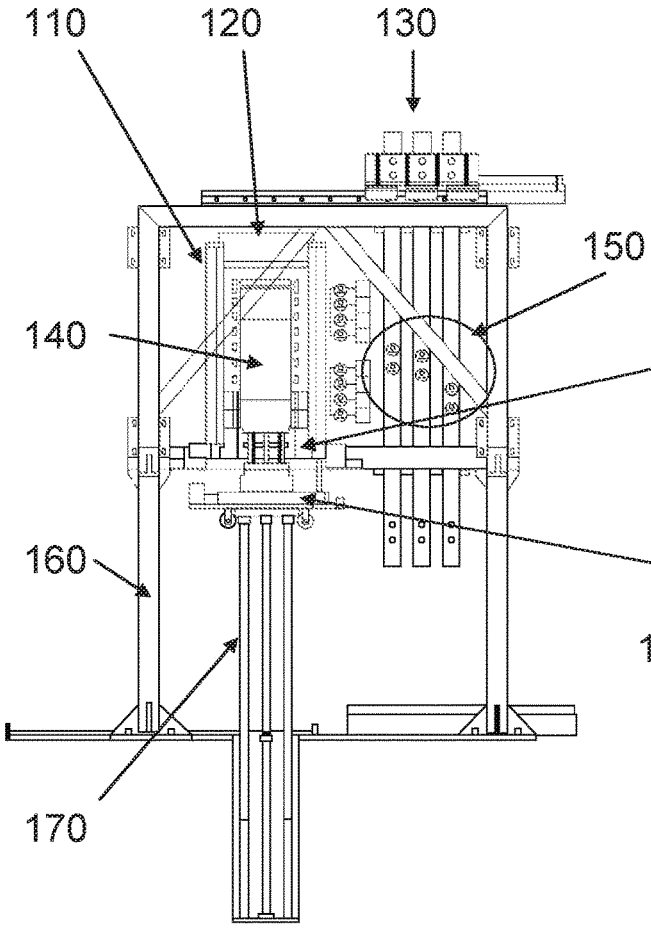
FIGS. 1A-1D are drawings of a nuclearized HIP system according to the present disclosure, which comprises a bottom loading HIP (FIG. 1A), an outer lower head (FIG. 1B), and inner lower head (FIG. 1C) and a top head (FIG. 1D).

It is to be understood that both the foregoing general description and the FIGS. are exemplary and explanatory only and are not restrictive of the invention, as claimed.

DETAILED DESCRIPTION

There are disclosed embodiments of a multi-wall HIP vessel for use in a toxic and/or nuclear environment and methods of using the same. In one embodiment, the multi-wall vessel comprises a dual walled vessel, and comprises a leak detection system between the vessel shells. By having a leak detection system located between the vessel shells, it is possible to measure gas leaking (e.g., from the seals) to give early indication that seals are losing performance and need to be replaced. Thus, in one embodiment, the leak detection system may be redundantly located at both ends of the vessel to give early detection of vessel cracking and/or leaking from the seals and thereby trigger safety systems.

In some embodiments of a double wall/shell vessel, a small spiral groove may be machined into the vessel shell, such that the spiral groove is located between concentric vessels. In this way, the spiral grove can be machined either on the outside of the inner vessel or on the inside of the outer vessel's interior diameter. When the two concentric vessels are assembled via shrink fitting and the vessels are together the grove forms a channel or pathway from the top of the vessel to the bottom. By using this design, Applicants have found that if a through crack develops in the first wall of the vessel, the contained gas in the HIP will leak between the vessel walls, and the gas will travel the path of least resistance and flow into the grooved channel. In addition, the grooved channel forms a path to allow the leaked gas to travel to the ends of the vessel and remain contained.

In one embodiment, the multi-walled vessels comprise end plates that bridge the interface of the multiple concentric vessel shells, which may allow the gas to be further directed via pipe work to a detection device to sense the leak.

In one embodiment, sensing of a gas leak can be done using one or more techniques, including measuring a pressure increase between the vessel walls, gas flow change, or a chemical detector, such as a gas detector. Thus, in various embodiments, there is contained between the vessel walls of a multi-walled HIP vessel at least one of the following: a pressure sensor, a flow meter, a gas analyzer, a radiation detector, a Geiger counter, or combinations thereof.

Upon the detection of an unwanted gas, such as by using one of the foregoing methods, the disclosed system is configured to open the HIP's vents to quickly reduce the pressure, preventing the crack from further growth. In addition, the control system could shut power to the furnace down in order to further prevent any increase in pressure via thermal expansion of the gas.

In addition to detecting a gas leak between associated concentric vessels and/or the breach of a vessel wall, there is described a method of detecting a vessel crack. In one embodiment, vessel crack detection can be accomplished by fitting the vessel with acoustic sensors and/or vibration sensors that listen for the formation of cracks in the vessel walls. In one embodiment, this detection is accomplished by first establishing finger print signals of the vessel in stressed (maximum Pressure) and non-stressed (atmospheric pressure) states. Acoustic signals for the vessel may also be established for other intermediate process pressurizing and heating cycles of the system. The acoustic finger print signal may be established by transmitting a sound wave into the vessel wall and recording the response or transmission on the recording sensor.

By using the foregoing protocols to establish a baseline acoustic "finger print" for the vessel, it is not only possible to determine if any crack develops under load, but the size of the crack can also be determined. In those situations in which the crack detected is longer than the critical crack length for the vessel design, action can be taken to shut the HIP down safely. In this way, the disclosed crack detection system, like the gas detection system, is configured to give real time data during the HIP cycle.

In addition to the described gas detection and crack detection system, the described system also monitors the condition of the Yokes in real time with quantifiable data. For example, in some embodiments, strain gauges are used to determine excessive deformation due to crack growth, and any greater stretch than is normal will lead to the control system venting and shutting down the HIP, as is the case during acoustic monitoring. The system is capable of real time monitoring so prompt action may be taken immediately before a safety issue can occur. In some embodiments, the disclosed system comprises multiple independent detection and alarm control systems. As a result, the disclosed system provides diversity and varying levels and types of redundancy for temperature and pressure control by a variety of different techniques and equipment.

In one embodiment, the HIP control system includes a programmable logic controller (PLC), or other similar programmable controller to control heating and pressurization rates, with control of automated vents to control gas pressure. An independent "hard wired" alarm control system ensures if the PLC malfunctions it cannot lead to an unsafe temperature and/or pressure condition that would damage the HIP system, since overheating of the furnace or the product could lead to both melting. As a result, the HIP system is configured to either manually or remotely load the disclosed system.

With reference to the figures, FIG. 1A shows a general layout for a bottom loading HIP system according to one embodiment of the present disclosure. The exemplary embodiment of FIG. 1A comprises a multi-wall vessel. In this case, a dual wall vessel 110 is shown. The dual-walled vessel 110 has a "leak before burst" design to mitigate catastrophic failure. In the exemplary embodiment, the outer vessel contains any potential debris from becoming a projectile that may cause damage to the containment structure (hot cell) or personnel. The vessel material may comprise an ASME Code compliant material, and either is a stainless steel or ASME Code approved alloy that is coated (e.g. Ni coating/plating) for corrosion resistance and ease of decontamination in the event of radioactive material release from the product being processed. In particular, vessel material(s) may be selected based on their ductile failure mode as prescribed under ASME Code. Materials of construction may either be stainless steel or plated material to eliminate risk of corrosion and/or stress corrosion cracking.

In the exemplary embodiment shown in FIG. 1A, the system further includes a HIP Frame 160, and a yoke 130 (multi-element). The yoke 130 shown in this embodiment comprises three elements. In one embodiment, the yoke 130 is designed to cover the entire span of the end closure opening. An advantage of the multi element yoke 130 design is that one element of the yoke 130 assembly can fail and the other elements are able to hold in the enclosures, allowing pressure relief yet containing components that may cause damage to the containment structure (hot cell) or personnel.

FIG. 1A further describes a series of strain gauges 150 on the elements of yoke 130. The strain gauges 150 may collect and provide real time stress data during a HIP run. The strain gauges 150 are fitted to yokes 130 which in turn give online monitoring capability, e.g., the condition of deformation of the yokes. Therefore, in the exemplary embodiment an early indication of potential failure is provided. In some embodiments, the early indication may assist with the triggering of preventative safety systems (venting of pressure).

In the exemplary embodiment shown in FIG. 1A, there is a bottom loading HIP system. The exemplary embodiment allows for bottom loading of the component to be pressed in the HIP can, represented by HIP can area 140. The HIP can area 140 can be raised using a variety of mechanisms 170, non-limiting examples of which include electric lift, hydraulic cylinders, pneumatic cylinders or machine screws, or a combination of all three.

In another embodiment, there may be a dual-bottom closure. This design allows the furnace and thermal barrier to stay in place inside the vessel and the work load head to lower independently. For example, the assembly is able to travel out from under the vessel allowing the component to be loaded on the platform. Then, the loaded platform may travel back under the vessel and be raised up into the furnace by mechanisms 170.

Figure 1B:
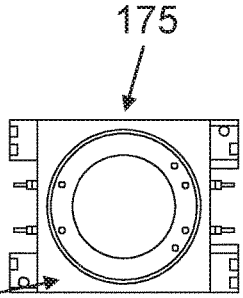

Turning to FIG. 1B, the outer lower head 175 of the system is shown. The furnace and thermal barrier (insulation) layer may be supported on this outer lower head 175. Additionally, power and signal data for the furnace may go through outer lower head 175. The outer lower head 175 can stay in the vessel while the inner lower head 180 is lowered to accept the part to be HIPed. In one embodiment, this component can lock in place via locking pins that can be automated to lock or release upon a signal command.

Figure 1C:
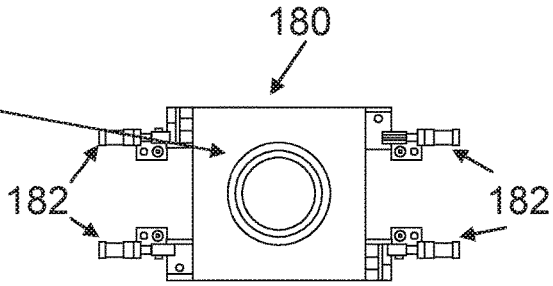

With reference to FIG. 1C, the inner lower head 180 of the system is shown. The inner lower head 180 holds the load stand on which the component to be HIPed is placed (represented by HIP can area 140). The inner lower head 180, or portions thereof, is dimensioned to fit into the inner diameter of the outer lower head 175. Furthermore, inner lower head 180 has sealing elements that are engaged when inserted into the bore of the outer lower head 175. In turn, the outer lower head 175 is sealed against the bore of the vessel. In addition, the inner lower head 180 keeps the furnace and thermal barrier in place when the component to be pressed is loaded and unloaded. An advantage of this embodiment is that the inner lower head 180 increases the life of the furnace and thermal barrier.

Figure 1D:
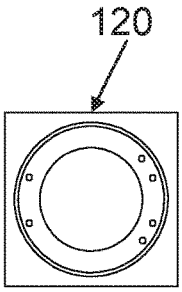

The inner lower head 180 has automated (pneumatic) pins/cylinders 182 that affix it to the outer lower head 175. For example, the outer lower head 175 is sized, dimensioned, and/or configured to operably couple and uncouple to the inner lower head 180 via the pins/cylinders 182. In this embodiment, when raised, the inner lower head 180 engages with the outer lower head 175 and the pins lock to it. The ram can then be lowered allowing for a path for the yoke to be moved over the top head of the system 120 (shown in FIG. 1D) and lower heads 175, 180 of the vessel 110

Figures 2A, 2B, 2C:
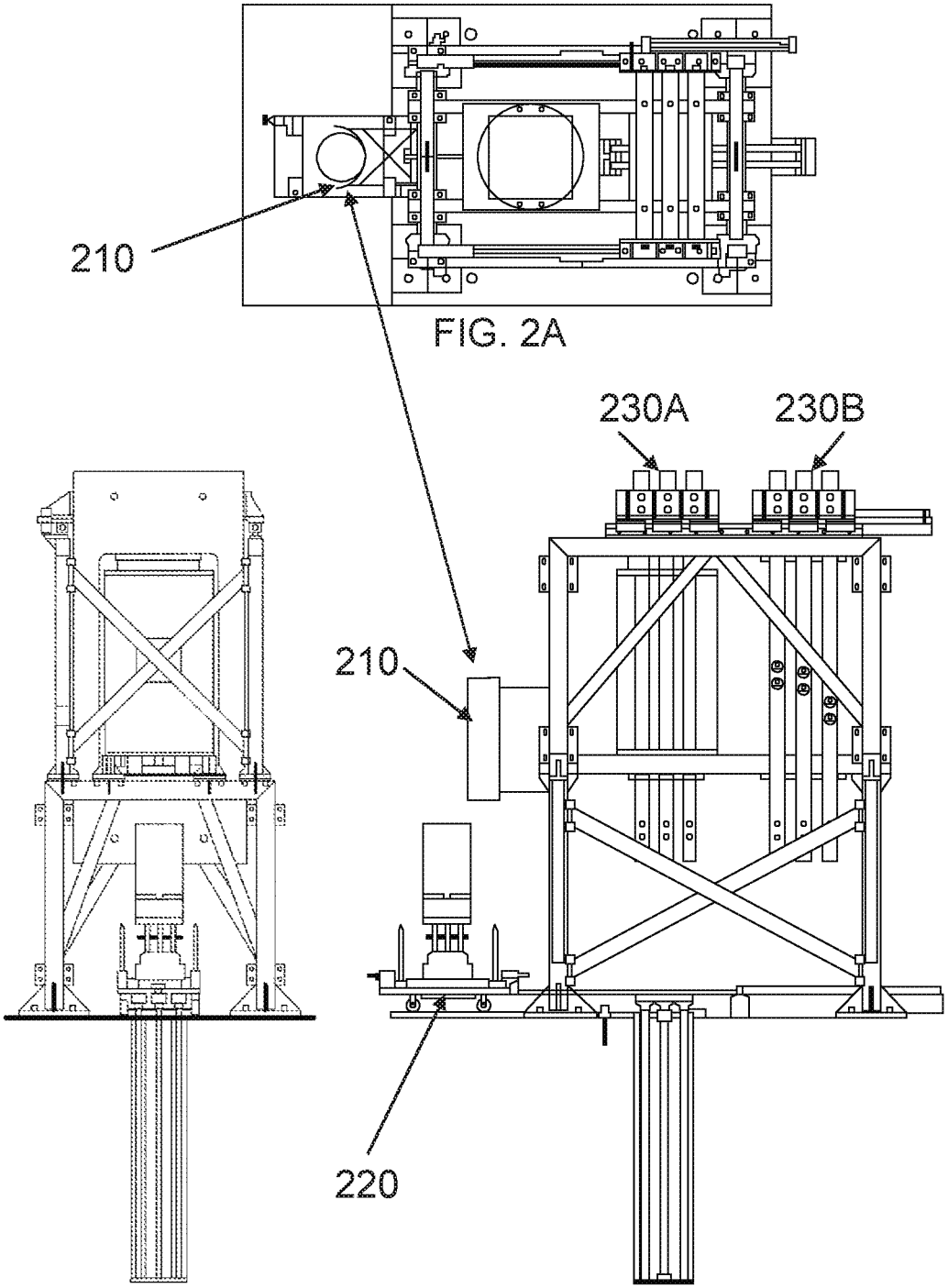
FIGS. 2A-2C are different perspectives of a nuclearized HIP system according to the present disclosure, including a top view (FIG. 2A), and end view (FIG. 2B) and a front view (FIG. 2C).

Turning to FIGS. 2A-2C, different perspectives of a nuclearized HIP system according to the present disclosure, including a top view (FIG. 2A), an end view (FIG. 2B), and a front view (FIG. 2C) are shown. With reference to FIG. 2A, showing a top view of the vessel 110 and system, it is noted that for the part loading guide 210, if the part is being loaded by overhead crane it is centralised to be placed on the load platform of the inner lower head.

FIG. 2C shows the inner lower head 180 (see FIG. 1C) can be pushed, pulled or driven on tracks or guides 220. When it is moved under the vessel bore to a region corresponding to the vessel bore's center-line the inner lower head 180 can be raised by mechanisms 170 (See FIG. 1A), such as a cylinder or motor screw that are configured to drive upwards into the vessel 110. Once in place, the pins/cylinders 182 lock the head in place and the elevator ram or drive retracts and the yoke is moved over the region corresponding to the center-line of the HIP vessel. FIG. 2C also shows the yoke 130 in a closed position 230A and an open position 230B. In the exemplary embodiment, the mechanism 170 (lifting cylinder) rises upward from a pit in the floor. However, mechanism 170 may alternatively be mounted in line with the vessel 110 and pull/push the head up and clear a pathway of the yoke 130 to move across.

Figure 3:
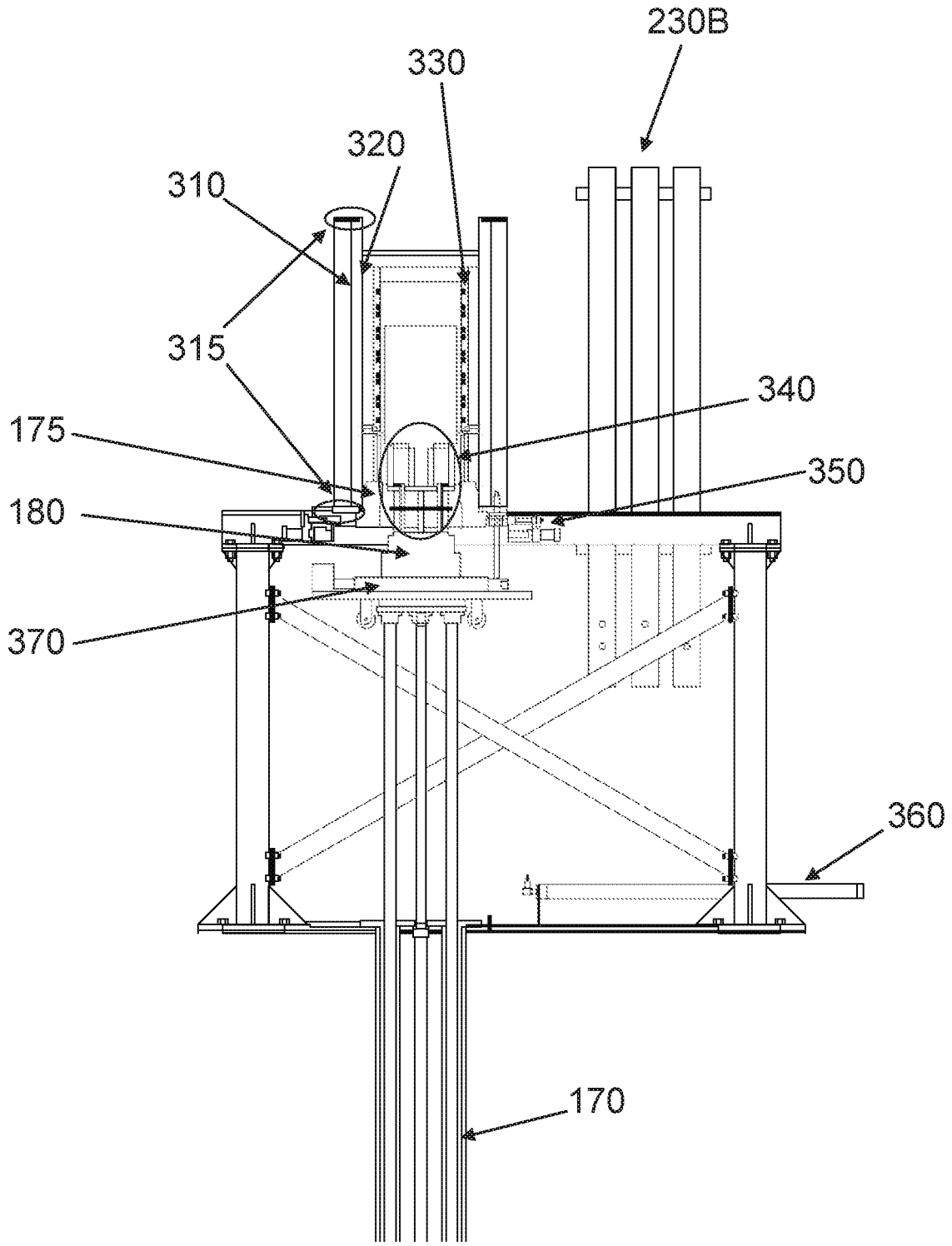
FIG. 3 is a drawing of a nuclearized HIP system according to the present disclosure that is similar to FIG. 1A, but with the yoke in an open position.

FIG. 3 shows a vessel on a stand and main with additional features and/or elements. These features/elements may include a dual walled vessel 310, with leak detection plates on both ends of the vessel 315. The exemplary embodiment further shows a thermal barrier layer, such as an insulation layer 320, surrounding the furnace 330. The load platform 340, may hold, load, and unload the HIP can. In the exemplary embodiment, the yoke is in an open position 230B state.

Other elements shown in FIG. 3 include the outer lower head 175 (from FIG. 1B), as well as the inner lower head 180 (from FIG. 1C), located on top of head carrier 370. In addition, pins/actuators 350, which hold the outer lower head 175 (furnace head) up are shown. Finally, there is shown a outer lower head push/pull apparatus 360 that is configured to removably couple to the inner lower head 180 and push/pull the inner lower head 180 when it is in the down position in a direction perpendicular to the raising/lowering direction of mechanism 170. This may be particularly advantageous, for example, when the lower furnace/thermal barrier is lowered for maintenance or repair to an external position. In the exemplary embodiment, the outer lower head push/pull apparatus 360 may be uncoupled when the inner lower head comes into a contact position and is ready to be raised. The coupling/uncoupling may occur in a variety of ways. For example, when the pins are disengaged the inner lower head 180 may be lowered thereby causing the furnace head to lower simultaneously. From the lowered position, the inner lower head 180 and or the furnace head can be moved to an external position from the system thereby allowing access to perform maintenance.

INDUSTRIAL APPLICABILITY

As shown, there is described a nuclearized hot-isostatic press (HIP) system comprising: a high temperature HIP furnace; a multi-wall vessel surrounding the furnace, wherein the multi-walled vessel comprises at least one detector contained between the walls to detect a gas leak, a crack in a vessel wall, or both. The at least one detector may comprise a pressure detector, a gas flow detector, a gas analyzer, a radiation detector, or an acoustic detector.

There is also described a system that comprises multiple heads located on top and underneath the furnace, including a top head, an outer lower head, and an inner lower head. In one embodiment, the outer lower head is configured to allow the furnace to sit on it. It can also be locked to the vessel while the inner lower head can be lowered to accept the part to be HIPed. In one embodiment, the inner lower head is configured to hold a stand on which the component to be HIPed is placed, and is configured to allow it to fit within the inner diameter of the outer lower head. The inner lower head may also contain at least one seal to form a seal with the outer head, and/or to keep the furnace and thermal barrier in place when the component to be pressed is loaded and unloaded. The inner lower head may also comprise at least one pneumatic pin, cylinder or clamp that couples it to the outer lower head. Also, the top head is typically located on top of the furnace and sits in the bore of the vessel.

In one embodiment, described a nuclearized HIP system comprises a yoke and a yoke frame. The yoke may comprise multiple elements and is configured to allow the yoke frame to remain operational upon the failure of one element of the yoke. In another embodiment comprises at least one strain gauge on the yoke configured to collect and provide real time stress data during the HIP run.

The described a nuclearized hot-isostatic press (HIP) system further comprises a lift mechanism configured to load and unload a HIP can to the high temperature HIP furnace. Non-limiting examples of the loading element include an electric lift, hydraulic cylinders, pneumatic cylinders, machine screws, or a combination thereof, to load and unload a HIP can from outside the HIP system to the HIP furnace.

In an embodiment, the loading element comprises a bottom loading design, and the system may further comprise a dual bottom closure design to allow the furnace and thermal barrier to stay in place inside the vessel while the HIP'ed component is removed from the system.

In an embodiment, the multi-wall vessel comprises two concentric vessels. This embodiment may also contain at least one groove between the vessels, wherein said groove is contained in the outside of the inner vessel or on the inside of the outer vessel, or both, and forms one or more pathways for gas located between the vessel walls to travel.

The nuclearized HIP system may also comprise at least one thermal barrier layer located between the furnace and the multi-walled vessel In one embodiment, the furnace of the HIP system is locked in place for normal operation with spring loaded catches. The latches can either be manually or automatically actuated.

In another embodiment, there is disclosed a method of hot isostatic pressing a material containing at least one heavy metal, toxic, or radioisotope using the nuclearized HIP system described herein. Non-limiting examples of such materials include all known constituents of spent nuclear fuel, mercury, cadmium, ruthenium, cesium, magnesium, plutonium, aluminum, graphite, uranium, and other nuclear power plant decommissioning wastes, zeolitic materials, and contaminated soils.

Other embodiments of the invention will be apparent to those skilled in the art from consideration of the specification and practice of the invention disclosed herein. It is intended that the specification and examples be considered as exemplary only, with the true scope of the invention being indicated by the following claims.

What is claimed is:

1. A nuclearized hot-isostatic press (HIP) system comprising:

a high temperature HIP furnace;

a multi-wall vessel surrounding the furnace, wherein the multi-walled vessel comprises an inner wall and an outer wall, at least one detector contained between the inner wall and the outer wall to detect a gas leak, a crack in a vessel wall, or both;

multiple heads located on top and underneath the furnace;

a yoke and a yoke frame; and a lift mechanism configured to load and unload a HIP can to the high temperature HIP furnace.

2. The nuclearized HIP system of claim 1, wherein the at least one detector comprises a pressure detector, a gas flow detector, a gas analyzer, a radiation detector, or an acoustic detector.

3. The nuclearized HIP system of claim 1, wherein multi-wall vessel comprises two concentric vessels.

4. The nuclearized HIP system of claim 3, wherein two concentric vessels contain at least one groove between the vessels, wherein said groove is contained in the outside of the inner vessel or on the inside of the outer vessel, or both, and forms one or more pathways for gas located between the vessel walls to travel.

5. The nuclearized HIP system of claim 1, wherein the yoke comprises multiple elements and is configured to allow the yoke frame to remain operational upon the failure of one element of the yoke.

6. The nuclearized HIP system of claim 1, further comprising at least one strain gauge on the yoke configured to collect and provide real time stress data during operation of the nuclearized HIP system.

7. The nuclearized HIP system of claim 1, wherein the multiple heads comprise a top head, an outer lower head, and an inner lower head.

8. The nuclearized HIP system of claim 7, wherein the outer lower head is configured to allow the furnace to sit on it.

9. The nuclearized HIP system of claim 8, wherein the outer lower head can be locked to the vessel while the inner lower head can be lowered to accept a part to be pressed in the nuclearized HIP system.

10. The nuclearized HIP system of claim 7, wherein the inner lower head is configured to hold a stand on which a part to be pressed in the nuclearized HIP system is placed, and is configured to allow the inner lower head to fit within the inner diameter of the outer lower head.

11. The nuclearized HIP system of claim 7, wherein the inner lower head contains at least one seal to form a seal with the outer head, and/or to keep the furnace and thermal barrier in place when the component to be pressed is loaded and unloaded.

12. The nuclearized HIP system of claim 7, wherein the inner lower head comprises at least one pneumatic pin, cylinder or clamp that couples it to the outer lower head.

13. The nuclearized HIP system of claim 7, wherein the top head is located on top of the furnace and sits in the bore of the vessel.

14. The nuclearized HIP system of claim 1, wherein the system comprises a loading element comprising an electric lift, hydraulic cylinders, pneumatic cylinders, machine screws, or a combination thereof, to load and unload a HIP can from outside the HIP system to the HIP furnace.

15. The nuclearized HIP system of claim 14, wherein the loading element comprises a bottom loading design.

16. The nuclearized HIP system of claim 15, wherein the system further comprises a dual bottom closure design to allow the furnace and thermal barrier to stay in place inside the vessel while a part that was pressed in the nuclearized HIP system is removed from the system.

17. The nuclearized HIP system of claim 1, wherein the furnace is locked in place for normal operation with spring loaded catches.

18. The nuclearized HIP system of claim 17, wherein the latches can either be manually or automatically actuated.

19. The nuclearized HIP system of claim 1, further comprising at least one thermal barrier layer located between the furnace and the multi-walled vessel.

* * * * *